US005281974A

United States Patent [19]

Kuramoto et al.

[11] Patent Number: 5,281,974

[45] Date of Patent: Jan. 25, 1994

[54] ANTENNA DEVICE CAPABLE OF REDUCING A PHASE NOISE

[75] Inventors: Akio Kuramoto; Toshinobu Yamane; Osamu Ichiyoshi; Kazuo Kosukegawa, all of Tokyo, Japan

[73] Assignee: NEC Corporation, Tokyo, Japan

[21] Appl. No.: 915,764

[22] Filed: Jul. 21, 1992

Related U.S. Application Data

[63] Continuation of Ser. No. 295,673, Jan. 11, 1989, abandoned.

[30] Foreign Application Priority Data

Jan. 11, 1988 [JP] Japan ..... 63-4133

[51] Int. Cl.[5] ..... H01Q 3/30; H01Q 21/22

[52] U.S. Cl. ..... 343/700 MS; 343/853; 342/372

[58] Field of Search ..... 343/700 MS, 777, 778, 343/844, 853; 342/79, 81, 354, 154, 157, 368, 371, 372; 333/161, 204; H01Q 21/22, 1 PC, 3/26–3/42

[56] References Cited

U.S. PATENT DOCUMENTS

| | | | |
|---|---|---|---|
| 3,276,018 | 9/1966 | Butler | 343/876 |
| 3,811,128 | 5/1974 | Munson | 343/787 |
| 3,854,140 | 12/1974 | Ranghelli | 342/371 |
| 4,045,800 | 8/1977 | Tang et al. | 343/854 |
| 4,343,006 | 8/1982 | McVeigh et al. | 342/368 |
| 4,467,328 | 8/1984 | Hacker | 343/844 |
| 4,792,805 | 12/1988 | Miglia | 342/372 |
| 4,799,065 | 1/1989 | Thompson | 343/853 |
| 4,849,763 | 7/1989 | DuFort | 342/372 |
| 4,882,587 | 11/1989 | Vodopia | 342/372 |

FOREIGN PATENT DOCUMENTS

| | | | |
|---|---|---|---|
| 0172411 | 8/1986 | Japan | H01Q 21/22 |
| 0006906 | 1/1988 | Japan | H01Q 3/26 |
| 1305804 | 4/1987 | U.S.S.R. | H01Q 3/26 |

OTHER PUBLICATIONS

I. J. Bahl et al, "Microstrip Antennas", Artech House 1979, pp. 270–287.

*Primary Examiner*—William Mintel
*Assistant Examiner*—Peter Toby Brown
*Attorney, Agent, or Firm*—Sughrue, Mion, Zinn, Macpeak & Seas

[57] ABSTRACT

In an antenna device comprising an antenna block which can electrically control a direction of a radio wave transmitted or received by the antenna device, a phase shift unit is connected to the antenna block to phase shift an external electric signal or an internal electric signal given to or from the antenna device. The phase shift unit has variable and discrete phase shifts switched from one to another in response to a control signal supplied from a controller and supplies a phase shifted external signal to the antenna block or a phase shifted internal signal to an external device. The antenna block comprises a plurality of antenna elements and a plurality of phase shifters which are connected to the antenna elements to send the phase shifted external signal to the respective antenna elements or to send the internal electric signal to the phase shift unit.

5 Claims, 4 Drawing Sheets

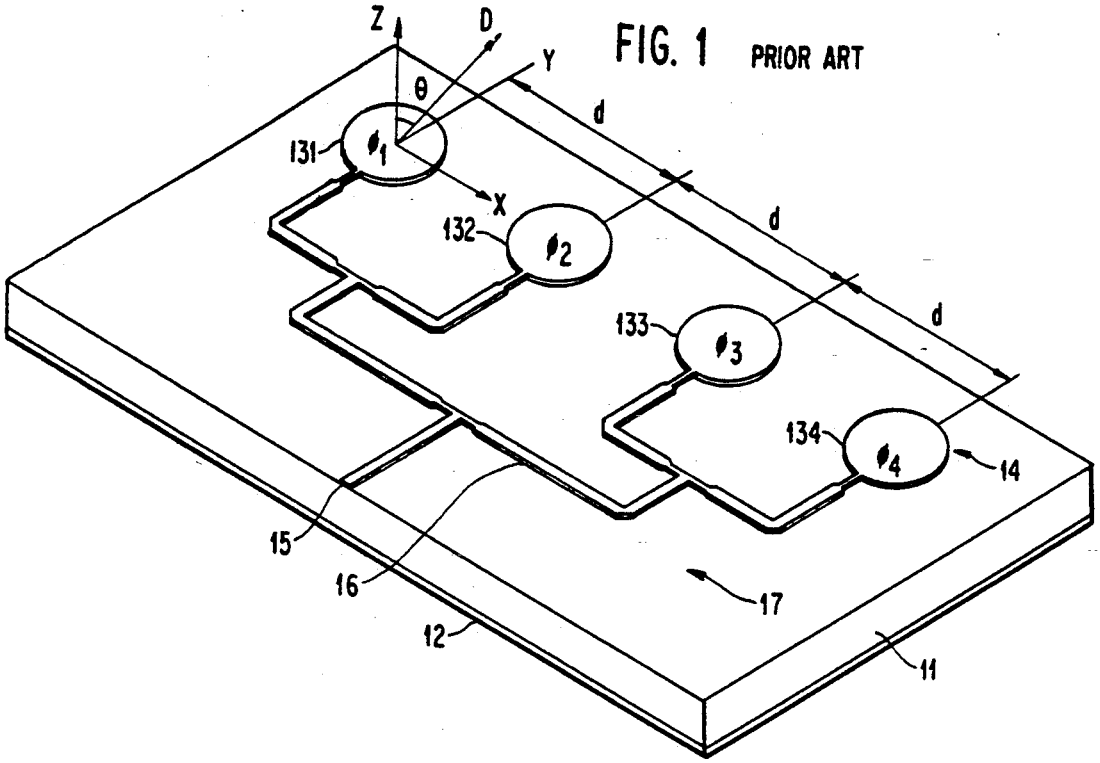
FIG. 1 PRIOR ART
FIG. 2
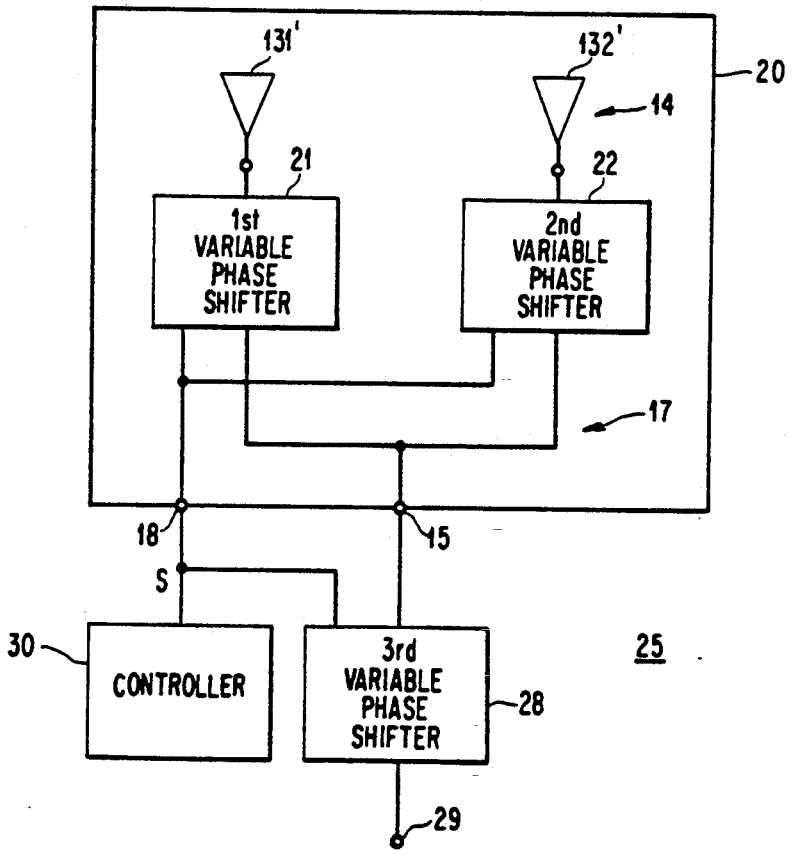

ANTENNA DEVICE CAPABLE OF REDUCING A PHASE NOISE

This is a Continuation of application No. 07/295,673 filed Jan. 11, 1989 and now abandoned.

BACKGROUND OF THE INVENTION

This invention relates to an antenna device for controlling a direction of a radio wave.

An antenna device of the type described is for use in transmitting or receiving a radio wave in an earth station for carrying out communication in a satellite communication system through a satellite. The earth station is often carried on an automobile and is therefore movable on the earth, communicating with the satellite. In this case, such a movable earth station must always follow or trace the satellite. Otherwise, communication is undesirably interrupted between the movable earth station and the satellite. To this end, the conventional antenna section comprises an antenna block mechanically driven to orient a radio wave towards the satellite. However, it is difficult to quickly trace the satellite by mechanically driving the antenna block because the movable earth station moves fast.

In order to quickly control the direction of the radio wave, an improved antenna device is disclosed on pages 270 to 287 of a book "Microstrip Antennas" written by I. J. Bahl and P. Bhartia and published 1979 by ARTECH HOUSE. In the improved antenna device, an antenna block is formed by an antenna section and a control section. The antenna section has a plurality of antenna elements which are spaced apart by a predetermined distance and which are driven in parallel while the control section is connected to the antenna section to electrically control the antenna section to electrically change the direction of the radio wave. The control section comprises a plurality of phase shifters connected to the antenna elements to individually phase shift input signals, respectively. As a result, the phase shifters produce phase shifted signals in accordance with phase shifts or phase shift values different from one another so as to electrically control the direction of the radio wave.

However, the phase shifters must be manufactured with a desired precision so as to realize desired phase shifts in the phase shifters. In general, it is very difficult to manufacture such phase shifters with the desired precision. Accordingly, some mechanical error is inevitable in the phase shifters. If phase differences between the phase shifts or phase shift values are different from the designed phase shifts in the phase shifters, noise takes place in a reception signal or a transmission signal due to the phase differences.

SUMMARY OF THE INVENTION

It is an object of this invention to provide an antenna device capable of quickly controlling a controllable direction of a radio wave.

It is another object of this invention to provide an antenna device capable of reducing any noise which might occur due to incompleteness of hardware.

Other objects of this invention will become clear as the description proceeds.

According to this invention, an antenna device comprises a control signal producing means for producing a control signal and an antenna block which has an internal terminal for an internal electric signal and which is supplied with the control signal. The antenna block is for carrying out conversion between a radio wave and the internal electric signal to electrically control a direction of the radio wave in response to the control signal and to thereby orient the radio wave. The antenna device comprises a phase shift unit which is connected to the internal terminal and to the control signal producing means and which has an external terminal for an external electric signal. The phase shift unit is operable in response to the control signal to selectively phase shift the internal and the external electric signals. Specifically, the external electric signal is phase shifted by the phase shift unit when the antenna device is used in transmitting the radio wave while the internal electric signal is phase shifted by the phase shift unit when the antenna device is used in receiving the radio wave.

An antenna device to which this invention is applicable comprises an antenna section directed to a controllable direction and a control section connected to the antenna section for electrically controlling the controllable direction. According to this invention, the control section comprises first means responsive to an input signal for producing a first signal having a first phase shift relative to the first signal, second means connected to the first means for producing a second signal having a second phase shift relative to the first signal, a terminal connected to the second means and to the first means when the antenna section is used in transmitting a transmission signal in the controllable direction and in receiving a reception signal from the controllable direction, and transmitting means for transmitting the second signal between the terminal and the antenna section as the transmission signal and the reception signal between the terminal and the antenna section as the first signal when the terminal is connected to the second means and the first means, respectively.

BRIEF DESCRIPTION OF THE DRAWING

FIG. 1 is a perspective view of a conventional antenna device;

FIG. 2 is a block diagram of an antenna device according to a first embodiment of this invention;

DESCRIPTION OF THE PREFERRED EMBODIMENTS

Figure 3:
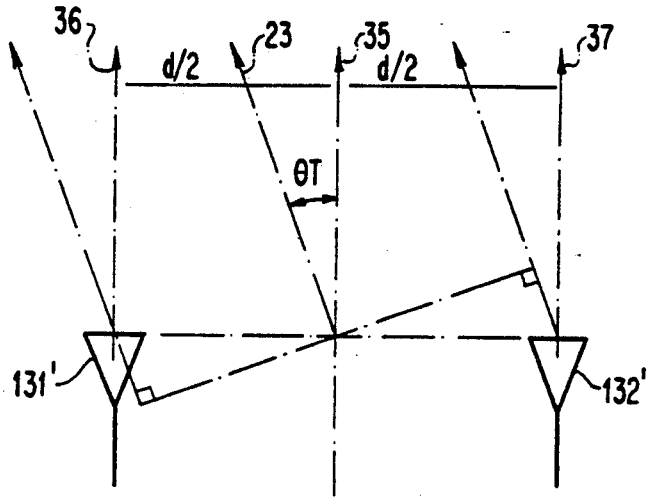
FIG. 3 is a view for use in describing operation of the antenna device illustrated in FIG. 2.

Referring to FIG. 1, description will be made with regard to a conventional antenna device for a better understanding of this invention. The illustrated antenna device is a planar array antenna device and comprises a dielectric plate 11 having a front surface and a back surface directed upwards and downwards as shown in FIG. 1, respectively, and a ground plate 12 attached to the back surface of the dielectric plate 11. First through fourth patch antenna elements 131, 132, 133, and 134 are deposited on the front surface of the dielectric plate 11 and have circular shapes defined by centers and radii.

Each radius of the patch antenna elements 131 to 134 may be substantially equal to one another. The illustrated patch antenna elements 131 to 134 are arranged in parallel so that the center of each patch antenna element is aligned with one another with a distance d between two adjacent centers of the patch antenna elements. For convenience of description, a direction of the aligned centers of the patch antenna elements may be referred to as an arrangement direction. The first through fourth patch antenna elements 131 to 134 collectively form an antenna section 14 which orients a radio wave in a controllable direction and serves to carry out conversion between the radio wave and an electric signal which may be called an internal electric signal. The controllable direction of the antenna section 14 may be determined by a direction of a main beam of the radio wave radiated from or received by the antenna section 14. It may be considered that the main beam is defined by a combination of pencil beams of the patch antenna elements.

The first through fourth patch antenna elements 131 to 134 are connected to an input/output terminal 15 through a microstrip line 16 which forms a guide section 17 for guiding the electric signal given from the antenna section 14 or the input/output terminal 15. More specifically, the illustrated microstrip line 16 comprises a first portion connecting the first and the second patch antenna elements 131 and 132 to each other, a second portion connecting the third and the fourth patch antenna elements 133 and 134 to each other, and a common portion connecting the first and the second portions in common. The illustrated guide section 17 connects each antenna element to the input/output terminal 15. In FIG. 1, distances between the input/output terminal and the respective antenna elements 131 to 134 as substantially equal to are practically one another, although such distances may be different from one another.

In order to describe a direction D of each pencil beam of the first through fourth patch antenna elements 131 to 134, an orthogonal coordinate is defined on each patch antenna element, although description will be restricted to the orthogonal coordinate on the first patch antenna element alone. The direction D of each pencil beam will be referred to as a maximum beam direction. In this event, an x-axis is determined along the arrangement direction mentioned above while a y-axis is perpendicular to the x-axis and is parallel to the front surface of the dielectric plate 11. In addition, a z-axis is determined perpendicular to the front surface of the dielectric plate 11.

Under the circumstances, it is known in the art that the direction D of each pencil beam is placed within an x-z plane provided by the x-axis and the z-axis and is decided by phases of the internal electric signals. Such phases of the electric signals will be called excitation phases hereinafter. Now, it is surmised that the first patch antenna element 131 which is placed at a leftmost position of FIG. 1 is selected as a reference antenna element and that the direction D of each pencil beam is inclined at an azimuthal angle $\theta$ with respect to the z-axis. Taking this into account, the excitation phases of the first through fourth patch antenna elements 131 to 134 are depicted as $\phi_1$ to $\phi_4$ and are given by:

$$\phi_n = -(2\pi d(n-1)\sin\theta)/\lambda_0 \text{ (radians)} \quad (1)$$

where n is a natural number variable between 1 and 4, both inclusive, and where $\lambda_0$ is a free space wavelength.

From Equation (1), it is readily understood that each excitation phase $\phi_n$ of the first through fourth patch antenna elements 131 to 134 is dependent on the natural number n. This shows that each excitation phase $\phi_n$ is determined by differences between lengths of the microstrip line 16. As a result, each maximum beam direction D of the pencil beams is uniquely determined by configurations of both the microstrip line 16 and the first through fourth patch antenna elements 131 to 134. In other words, it is difficult for the conventional antenna device to vary the maximum beam direction D without physical or mechanical movement of the dielectric plate 11, as pointed out in the preamble of the instant specification. Consideration might be made about connection of a phase shifter to each of the first through fourth patch antenna elements 131 to 134 so as to electrically control each maximum beam direction of the first through fourth patch antenna elements 131 to 134.

However, it is also difficult to accurately make each length of the microstrip line equal to a designed length without any mechanical error. Therefore, an objectionable phase error or noise inevitably takes place in the conventional antenna device even when the phase shifters are connected to the patch antenna elements, as also pointed out in the preamble of the instant specification.

Referring to FIG. 2, an antenna device according to a first embodiment of this invention comprises an antenna section 14 and a guide section 17 similar to those in FIG. 1. In the illustrated example, both the antenna and the guide sections 14 and 17 form an antenna block which has an input/output terminal 15 and a control terminal 18 and which is depicted as 20. The antenna section 14 comprises first and second antenna elements 131' and 132' which may be either patch antenna elements as in FIG. 1 or electromagnetic horn antenna elements. On the other hand, the illustrated guide section 17 comprises first and second variable phase shifters 21 and 22 which are interconnected to the antenna elements 131' and 132' at first and second inner terminals depicted by white dots in FIG. 2, respectively, and each of which is connected to the input/output terminal 15 and the control terminal 18. The first and the second inner terminals may be collectively referred to as a terminal set.

A control unit 25 is connected to the input/output terminal 15 and the control terminal 18 so as to control the first and the second variable phase shifters 21 and 22 in a manner to be described later. The guide section 17 and the control unit 25 are collectively called a control section for electrically controlling a controllable direction of a radio wave. The control unit 25 comprises a third variable phase shifter 28 between the input/output terminal 15 and an external terminal 29 and a controller 30 connected to the control terminal 18. The input/output terminal 15 may be called an internal terminal. The controller 30 is also connected to the third variable phase shifter 28. The guide section 17 is formed so that an electrical length between the input/output terminal 15 and the first antenna element 131' becomes equal to an electrical length between the input/output terminal 15 and the second antenna terminal 132' with the first and the second variable phase shifters 21 and 22 removed from the antenna block 20.

The illustrated controller 30 continuously delivers a control signal S to the first through third variable phase shifters 21, 22, and 28 during operation of the antenna device. The control signal S may be periodically varied with time and may therefore be a digital signal. Each of the first and the second variable phase shifters 21 and 22 may be similar in structure to one another, and has a phase shift characteristic which is specified by first and second phase shifts, namely, first and second phase shift values $+\phi$ and $-\phi$. The first and the second phase shifts $+\phi$ and $-\phi$ are discretely switched from one to another in response to the control signal S. It is assumed that each variable phase shifter discretely varies or shifts a phase of the electric signal by the first and the second phase shifts $+\phi$ and $-\phi$. Herein, the plus and the minus signs+ and − are assumed to represent a phase lead and a phase lag, respectively. At any rate, a practical phase shift in each variable phase shifter is given by a difference between the phase of the electric signal and each of the first and the second phase shifts $+\phi$ and $-\phi$.

Referring to FIG. 3 together with FIG. 2, operation will be described on the assumption that the third variable phase shifter 28 is removed from the illustrated antenna device and that a radio wave is radiated from the first and the second antenna elements 131' and 132'. This means that the antenna section is used to transmit a transmission signal as the radio wave in the controllable direction in response to an external electric signal given through the external terminal 29. In addition, the first and the second variable phase shifters 21 and 22 are differentially driven by the control signal S. Namely, the first variable phase shifter 21 phase shifts the external electric signal by the first phase shift $+\phi$ when the second phase shift $-\phi$ is given by the second variable phase shifter 22. On the other hand, the first variable phase shifter 21 provides the second phase shift $-\phi$ when the first phase shift $+\phi$ is given by the second variable phase shifter 22. As shown in FIG. 3, the first and the second antenna elements 131' and 132' are symmetrical with respect to a center axis 35 and have first and second beam axes 36 and 37 which are parallel to the center axis 35. In this case, a distance d between the first and the second antenna elements 131' and 132' is kept at a length equal to a half of a wavelength of the radio wave. This shows that a distance d/2 between the center axis 35 and each of the first and the second beam axes 36 and 37 is equal to a quarter of the wavelength.

On radiating the radio wave, the external electric signal is sent from the external terminal 29 to the first and the second variable phase shifters 21 and 22 through the input/output terminal 15 with each phase of the electric signal kept in phase.

In FIG. 3, a composite radio beam is radiated along the center axis 35 on the above-mentioned assumption without the first and the second variable phase shifters 21 and 22. Such a composite radio beam results from the radio waves radiated from the first and the second antenna elements 131' and 132'. When the second and the first phase shifts $-\phi$ and $+\phi$ are given by the first and the second variable phase shifters 131' and 132', respectively, the composite radio beam is inclined with respect to the center axis 35 at an azimuthal angle of $\theta T$ which is measured counterclockwise.

Under the circumstances, a relationship between the angle $\theta T$ and each phase shift $\phi$ is given by:

$$\phi=(\beta d/2)\sin\theta T, \quad (2)$$

where $\beta$ is representative of a phase constant in free space.

Figure 4:
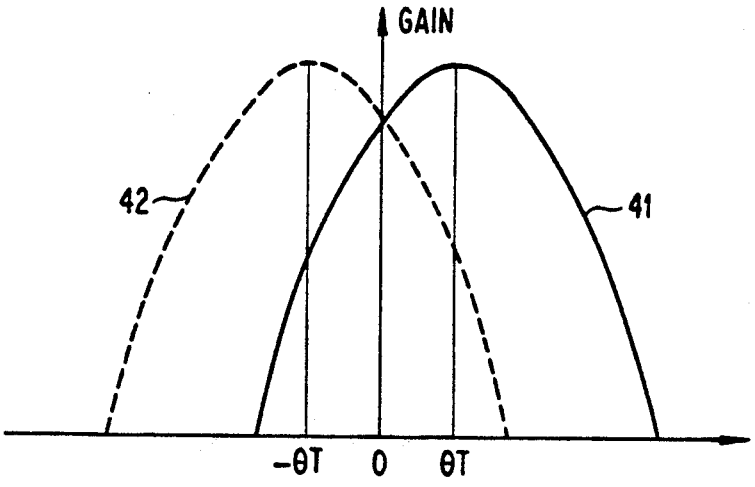
FIG. 4 is another view for use in describing operation of the antenna device illustrated in FIG. 2.

Referring to FIG. 4 in addition to FIG. 3, wherein an abscissa and an ordinate represent the azimuthal angle $\theta T$ of the composite radio beam with respect to the center axis 35 and an antenna gain, respectively, a curve 41 (depicted as a solid line) shows a variation of the antenna gain in relation to the azimuthal angle $\theta T$ when the first and the second variable phase shifters 21 and 22 have the second and the first phase shifts $-\phi$ and $+\phi$, respectively, while another curve 42 (depicted as a broken line) shows a similar variation of the antenna gain when the first and the second variable phase shifters 21 and 22 have the first and the second phase shifts $+\phi$ and $-\phi$, respectively.

As readily understood from FIG. 4, the antenna gain is kept invariable on the center axis 35 even when the phase shifts are periodically changed from one to another in the first and the second variable phase shifters 21 and 22, although the azimuthal angles for a maximum antenna gain are switched between $-\theta T$ and $+\theta T$. Therefore, when the center axis 35 is correctly directed towards an opposite end or destined station, the composite radio wave is received by the opposite end with the antenna gain kept unchanged, in spite of the fact that the phase shift values are periodically switched in the first and the second variable phase shifters 21 and 22 in response to the control signal 8. In other words, the antenna gain is changed on the center axis 35 at every period of the control signal S when the destined station is not correctly placed on the center axis 35.

At any rate, the composite radio beam is scanned within an azimuthal range between the azimuthal angles $+\theta T$ and $-\theta T$ when the illustrated antenna device is used to radiate the radio wave.

On the other hand, when the illustrated antenna device is used to receive the radio wave, it is possible to correctly direct the center axis 35 towards the destined station by detecting a variation of a reception level of a reception signal resulting from the radio wave and by mechanically adjusting the antenna device so that the variation of the reception level may be removed.

However, it is practically difficult to establish a complete differential operation of the first and the second variable phase shifters 21 and 22. Therefore, objectionable phase modulation inevitably takes place in either the radio wave or the internal electric signal.

For example, the designed phase shift values may be equal to ±7.84 degrees to obtain the azimuthal angle $\theta T$ of ±5 degrees. Herein, it is assumed that the first variable phase shifter 21 has practical phase shifts or shift values of +5 and −10 degrees due to a fabrication error, although practical phase shifts of the second variable phase shifter 22 are equal to the designed phase shifts of ±7.84 degrees. In this event, the azimuthal angles $\theta T$ of the composite radio beam are varied between +6 and −4 degrees with respect to the center axis 35 when the third variable phase shifter 28 is not connected to the input/output terminal 15. Under the circumstances, relative phases between the internal electric signal and the radio wave are changed between −1.08 degrees and −1.42 degrees. The relative phases result in phase modulation of either the transmission signal or the reception signal by a phase variation which is given by a difference between the relative phases and which is equal to (−1.08 +1.42), namely, 0.34 degree.

Now, the third variable phase shifter 28 is included in the control section of the illustrated antenna device so that objectionable phase modulation can be avoided, even when each of the first and the second variable phase shifters 21 and 22 has a phase shift which is different from a designed phase shift value. Practically, the above-mentioned phase variation of 0.34 degree can be removed by the use of the third variable phase shifter 28, which selectively provides a phase shift of 0.34 degree in response to the control signal S. In other words, the third variable phase shifter 28 switches phase shift values from zero to 0.34 degree in response to the control signals.

At any rate, the third variable phase shifter 28 phase shifts the external electric signal on radiation of the radio wave. On reception of the radio wave, the third variable phase shifter 28 phase shifts an internal electric signal sent from the input/output terminal 15.

Such a third variable phase shifter 28 can be structured in a manner similar to the first and the second variable phase shifters 21 and 22.

When the antenna section 14 is used in transmitting the transmission signal, an input electric signal is supplied through the external terminal 29 to the third variable phase shifter 28 to be phase shifted into a first signal which has a first phase shift relative to the input electric signal. In this connection, the third variable phase shifter 28 may be referred to as a primary phase shifter and acts as a first phase shift circuit. The first signal is delivered to the first and the second variable phase shifters 21 and 22 in parallel through connection lines between the third variable phase shifter 28 and the first and the second variable phase shifters 21 and 22.

The first and the second variable phase shifters 21 and 22 act as a second phase shift circuit for producing a second signal having a second phase shift relative to the first signal and may be called first and second subsidiary phase shifters for individually phase shifting the first signal to produce individually phase shifted signals as the second signal.

The individually phase shifted signals are sent to the first and the second antenna elements 131' and 132' through the first and the second inner terminals and conductors between the inner terminals and the antenna elements 131' and 132'. Thus, the conductors serve to transmit the individually phase shifted signals to the antenna elements 131' and 132'.

On the other hand, when the antenna section 14 is used in receiving the reception signal, the first and the second antenna elements 131' and 132' supply the first and the second variable phase shifters 21 and 22 with individual reception signals as the reception signal through the conductors and the first and the second inner terminals, respectively.

The first and the second variable phase shifters 21 and 22 are supplied with the individual reception signals as an input electric signal and operable as a first phase shift circuit for phase shifting the input electric signal into a first signal having a first phase shift relative to the input electric signal. Specifically, the first and the second variable phase shifters 21 and 22 serve to phase shift the individual reception signals into the individual phase shifted signals which are sent through the connection lines to the third variable phase shifter 28. In this event, the first and the second variable phase shifters 21 and 22 may be called main phase shifters.

The third variable phase shifter 28 may be referred to as a second phase shift circuit for phase shifting the first signal into a second signal which has a second phase shift relative to the first signal.

Figure 5:
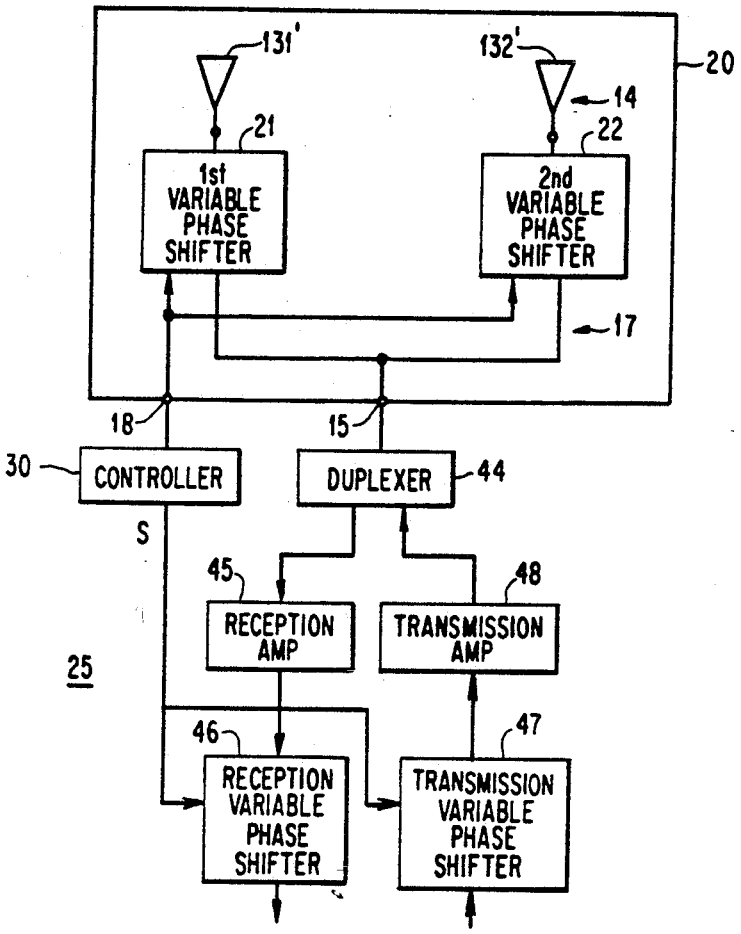
FIG. 5 is a block diagram of an antenna device according to a second embodiment of this invention.

Referring to FIG. 5, an antenna device according to a second embodiment of this invention is similar in structure and operation except that the control unit 25 illustrated in FIG. 5 comprises a duplexer 44, a reception amplifier 45, a reception variable phase shifter 46, a transmission variable phase shifter 47, and a transmission amplifier 48. The reception and the transmission variable phase shifters 46 and 47 are controlled by a control signal S in a manner similar to that illustrated in FIG. 2. As readily understood from FIG. 5, the antenna block 20 is used in common to receive and transmit a radio wave. The radio wave received through the antenna section 14 is given in the form of a reception electric signal to the reception variable phase shifter 46 through the duplexer 44 and the reception amplifier 45. The reception electric signal is phase shifted by the reception variable phase shifter 46 into a reception phase shifted signal to be sent to an external circuit (not shown). On the other hand, a transmission electric signal which is given to the transmission variable phase shifter 47 is subjected to phase shift and is sent as a transmission phase-shifted signal to the antenna section 14 through the transmission amplifier 48, and the duplexer 44. The transmission phase-shifted signal is radiated as a radio wave through the antenna elements 131' and 132'.

With this structure, it is possible to remove insertion losses which might occur due to connections of the reception and the transmission variable phase shifters 46 and 47. This makes it possible to avoid a reduction of ability to receive and transmit a radio wave.

Although description has thus far been restricted to the antenna device comprising two antenna elements, this invention is readily applicable to an antenna device comprising four or more antenna elements.

Figure 6:
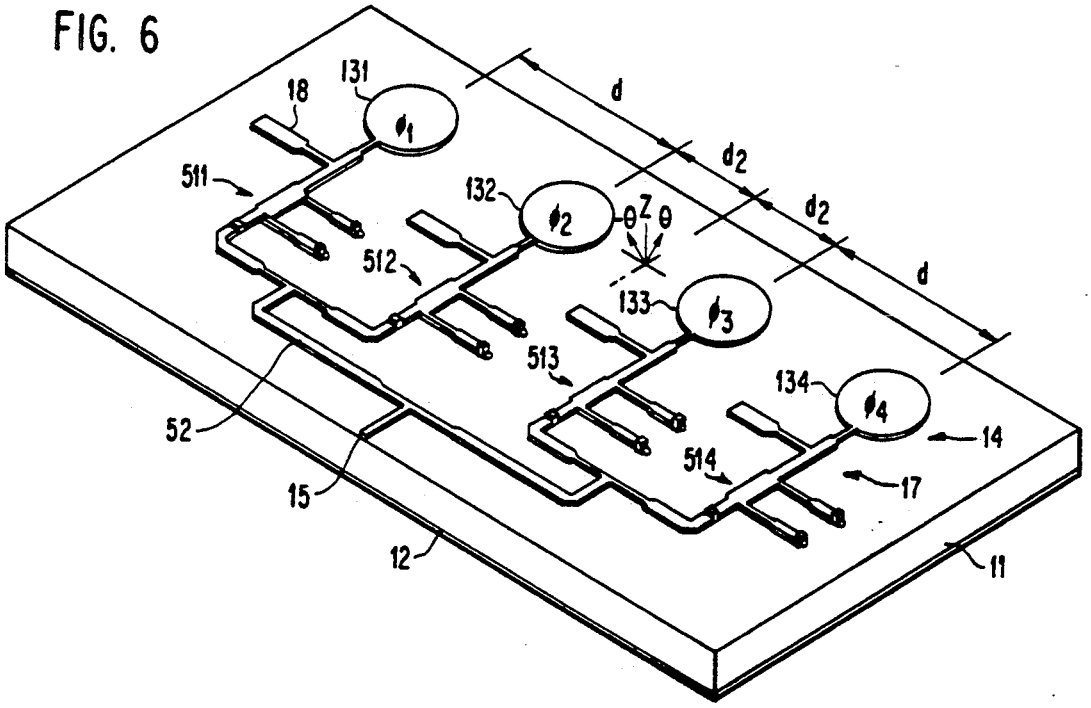
FIG. 6 is a perspective view for use in describing an antenna block used in FIGS. 2 and 5 in detail.
Figure 7:
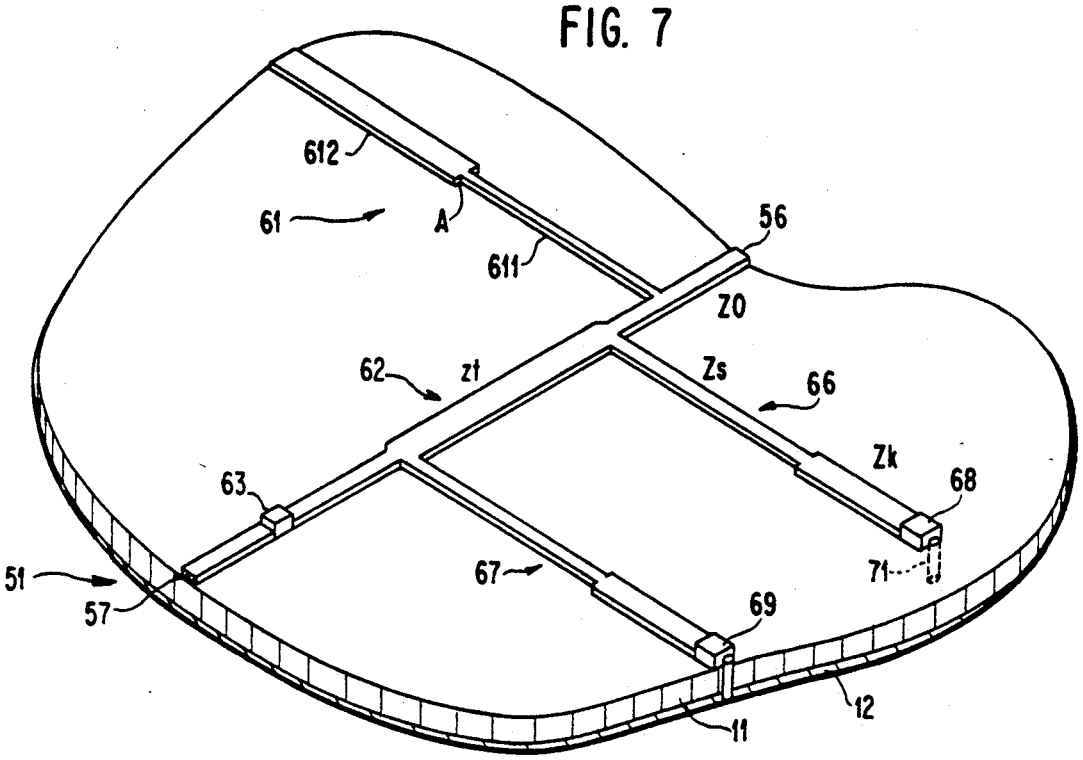
FIG. 7 is an expanded view of a part of the antenna block illustrated in FIG. 6.

Referring to FIGS. 6 and 7, an antenna block 20 is applicable to that illustrated in FIGS. 2 and 5 and is similar to that illustrated in FIG. 1 except that the guide section 17 illustrated in FIG. 6 comprises first through fourth variable phase shifters. The first through fourth variable phase shifters 511 to 514 are connected to the first through fourth patch antenna elements 131 to 134 of the antenna section 14, respectively. The first through fourth variable phase shifters 511 to 514 are connected in common to the input/output terminal 15 through a microstrip line 52 which may be called a conducting member for conducting an electric signal. Each of the first through fourth variable phase shifters 511 to 514 is similar in structure to one another. Therefore, only one of the first through fourth variable phase shifters 511 to 514 is shown at 51 in FIG. 7.

As shown in FIGS. 6 and 7, the variable phase shifter 51 is located between a first primary line 56 extended from one of the antenna elements 131 to 134 and a second primary line 57 extended from the microstrip line 52 (FIG. 7). The first and the second primary lines 56 and 57 have the same width and are located with a spacing left therebetween. In FIG. 7, the variable phase shifter 51 comprises a bias portion 61 connected to an intermediate portion of the first primary line 56 and a transformer 62 connected between the first and the second primary lines 56 and 57. In addition, the variable phase shifter 51 comprises a capacitor 63 inserted on the way of the second primary line 57. First and second stubs 66 and 67 are connected to both ends of the transformer 62 and terminated by first and second diodes 68 and 69 each of which is connected to the ground plate 12 by a shorting bar 71 embedded in the dielectric plate 11 and which is implemented, for example, by a PIN diode. The first and the second diodes 68 and 69 are inversely connected in polarity of each diode between the ground plate 12 and the stubs 66 and 67.

More specifically, the bias portion 61 comprises a narrow portion 611 connected to the first primary line 56 and a wide portion 612 having an end connected to the narrow portion 611 and an opposite open end. As a result, an intermediate end portion A is formed between the narrow and the wide portions 611 and 612. Herein, it is noted that the intermediate end portion A is put into a substantially opened state within a high frequency band and is put into a substantially shortened state on supply of a d.c. voltage. Accordingly, an impedance becomes infinitely large on reception of an electric signal of a high frequency band when the intermediate end portion A is seen from the first primary line 56. Practically, the impedance may be 1000 ohms or so. To this end, it is preferable that the narrow portion 611 is as narrow as feasible. On the other hand, the wide portion 612 is preferably deposited as wide as feasible so as to reduce an impedance of the wide portion 612 for a d.c. voltage.

The transformer 62 is formed by a microstrip line of a length equal to $\lambda_g/4$, where $\lambda_g$ is a single wavelength on the microstrip line. Such a wavelength $\lambda_g$ is given by:

$$\lambda_g \approx \lambda_0/\sqrt{\epsilon_r},$$

where $\lambda_0$ is representative of a free space wavelength and $\epsilon_r$, a dielectric constant of the dielectric plate 11.

Each of the first and the second stubs 66 and 67 has narrow and wide stub portions which provide inductive and capacitive line impedances zs and zk, respectively. The narrow and the wide stub portions are designed so that an absolute value of the inductive line impedance zs becomes equal to that of the capacitive line impedance zk. Inasmuch as the first and the second diodes 68 and 69 are alternatingly turned on and off when the d.c. voltage is supplied as the control signal S (FIG. 2) to the bias portion 61, the first and the second stubs 66 and 67 are selectively and alternatingly rendered inductive and capacitive in a manner to be described later. Consequently, the transformer 62 has an impedance zt resulting from the inductive and the capacitive line impedances zs and zk and matches the impedance zt with impedances of the first and the second primary lines 56 and 57.

Furthermore, the capacitor 63 serves to cut a d.c. current resulting from supply of the d.c. voltage to the wide portion 612 and to prevent the d.c. current from leaking through the input/output terminal 15.

With this structure, the d.c. voltage is supplied as the control signal S (FIG. 2) from the controller 30 to the first and the second diodes 68 and 69 through the wide portion 612, as mentioned above. Supplied with the d.c. voltage, one of the first and the second diodes 68 and 69 is turned on while the other one is turned off. Therefore, either one of the first and the second stubs 66 and 67 is put into the opened state while the remaining one of the stubs is put into the shortened state. This shows that the opened stub becomes capacitive while the shortened stub becomes inductive. Thus, two different phase shifts are provided in the antenna block by switching the first and the second diodes 68 and 69 in the above-mentioned manner.

At any rate, each of the first through fourth variable phase shifters 511 and 514 is operable to drive each antenna element in two different excitation phases. Thus, a maximum beam direction of a main beam can be switched from $+\theta$ to $-\theta$ with respect to the z-axis without a mechanical movement of the antenna block 20, as illustrated in FIG. 6. This enables high speed scanning of the main beam.

Practically, let a center axis be determined between the second and the third patch antenna elements 132 and 133, as indicated at the y-axis in FIG. 6. In addition, it is assumed that a phase reference of the illustrated antenna block 20 is determined along the center axis and that a maximum beam direction, namely, an azimuthal angle of the main beam is inclined at an angle $\theta$ with respect to the z-axis. Under the circumstances, each excitation phase of the first through fourth patch antenna elements 131 to 134 is determined by:

$$\phi_n=(1/\lambda_0)2\pi d(((N+1)/2)-n)\sin\theta,$$

where N is representative of a total number of the antenna elements and is equal to four in FIG. 6 and n is representative of a natural number variable between unity and four, both inclusive.

Figure 8:
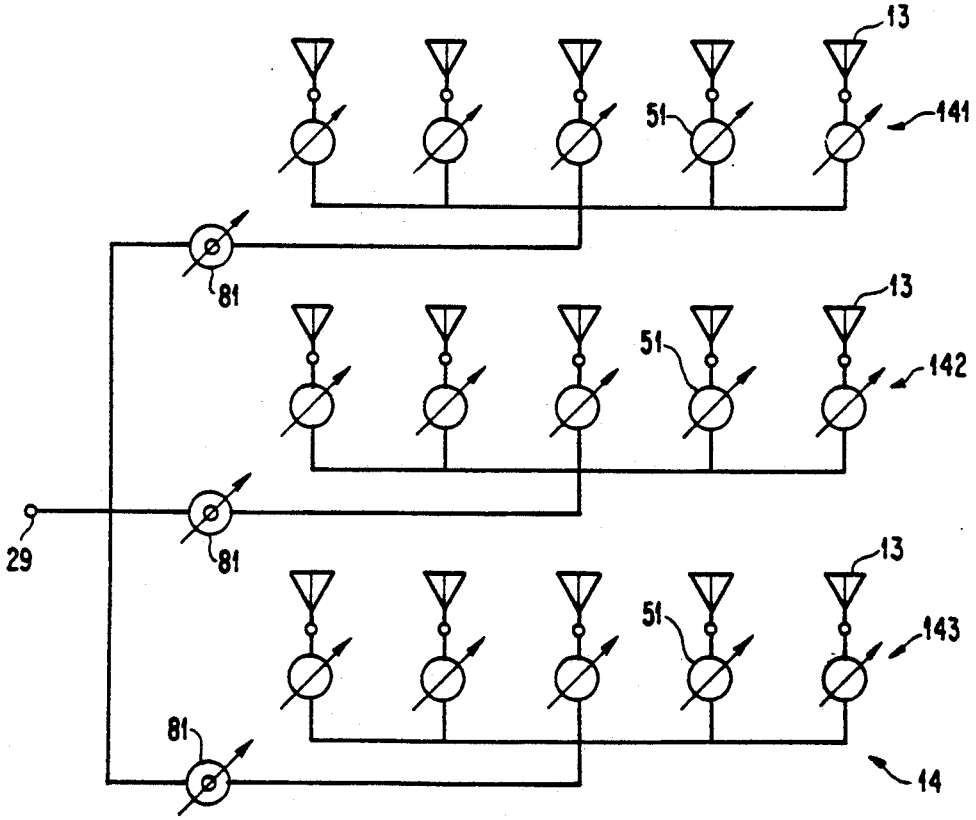
FIG. 8 is a block diagram of an antenna device according to a third embodiment of this invention.

Referring to FIG. 8, an antenna device according to a third embodiment of this invention comprises similar parts designated by like reference numerals and enables two dimensional scanning of a main beam. For this purpose, the illustrated antenna section 14 is classified into first through third array groups 141 to 143, each of which comprises five antenna elements (depicted at 13). As a result, the antenna elements 13 are arranged in three rows and five columns. The antenna elements 13 are connected to primary variable phase shifters collectively depicted at 51, respectively. The primary variable phase shifters of each group are connected in common to an additional variable phase shifter collectively depicted at 81. Each additional variable phase shifter 81 is connected in common to the external terminal 29, as shown in FIG. 8. Each of the primary and the additional variable phase shifters illustrated in FIG. 8 is similar in structure to that illustrated in FIG. 6.

In the example illustrated in FIG. 8, the primary variable phase shifters 51 of each group are successively switched from one to another along each row direction while the additional variable phase shifters 81 are also successively switched from one to another along a column direction. In FIG. 8, when the antenna device is used in receiving the reception signal, the primary variable phase shifters 51 are operable as a first phase shift circuit for phase shifting an input electric signal into a first signal while the additional variable phase shifters 81 are operable as a second phase shift circuit for phase shifting the first signal into a second signal, as mentioned in conjunction with FIG. 2. On the other hand, when the antenna device is used in transmitting the transmission signal, the additional variable phase shifters 81 are operable as a first phase shift circuit for phase shifting an input electric signal into a first signal while the primary variable phase shifters 51 are operable as a second phase shift circuit for phase shifting the first signal into a second signal.

While this invention has thus far been described in conjunction with a few embodiments thereof, it will readily be possible for those skilled in the art to put this invention into practice in various other manners. For example, each patch antenna element may be rectangular or the like. Each antenna element may be a parabola antenna. The antenna device can be used for radiating or receiving either a circular polarized wave or a linear polarized wave. In FIG. 5, a single variable phase shifter may be located between the internal terminal 15 and the duplexer 44 instead of the reception and the transmission variable phase shifters 46 and 47.

What is claimed is:

1. An antenna device reciprocally operable for transmitting and receiving a radio wave, said antenna device comprising an antenna section for orienting said radio wave to a controllable direction and a control section connected to said antenna section for electronically controlling said controllable direction of the radio wave, said control section comprising an antenna block and an external terminal outside of said antenna block, said antenna block having a first set of inner terminals connected to said antenna section, a control terminal for receiving a control signal, and an input/output terminal, said control section comprising:

a first set of variable phase shifters each of which is formed in said antenna block and each of which is connected to a respective one of said first set of the inner terminals, said control terminal, and said input/output terminal and each of which variably phase shifts, under control of said control signal, an electric signal which is allowed to reciprocally pass through each of said variable phase shifters between one of said inner terminals of the first set and said input/output terminal, each of the electric signals being subjected to phase shifts in the variable phase shifters, resulting in phase shifted electric signals with accompanying phase errors different from one another;

additional variable phase shift means located outside of said antenna block and connected to said input/output terminal, said external terminal, and said control terminal, said additional variable phase shift means being for variably phase shifting, under control of said control signal, an additional electric signal which is allowed to pass through said additional variable phase shift means between said input/output terminal and said external terminal to compensate for said phase errors, said additional electric signal being subjected to a phase shift in said additional variable phase shift means into an additional phase shifted electric signal which compensates for said phase errors in said phase shifted electric signals, said additional electric signal being given to said additional variable phase shift means either after a combination of said electric signals or before distribution to said first set of the variable phase shifters as said electric signals;

control means connected to said control terminal to be connected therethrough to said first set of variable phase shifters and the additional variable phase shift means through said control terminal, said control means being for producing said control signal to vary the phase shifts in said first set of the variable phase shifters and the additional variable phase shift means and to thereby control said first set of the variable phase shifters and said additional variable phase shift means;

wherein said antenna section comprises a plurality of antenna elements which are spaced apart by a predetermined distance and which are individually connected to said inner terminals associated with the first set of the variable phase shifters, and wherein said additional variable phase shift means include means for receiving said additional electric signal from said external terminal to produce said additional phase shifted electric signal through said input/output terminal when a radio signal is to be transmitted and comprises:

a primary variable phase shifter connected between said external terminal and said input/output terminal for phase shifting said additional electric signal into said additional phase shifted electric signal; and first signal supplying means for supplying said additional phase shifted electric signal from said input/output means to said first set of variable phase shifters;

wherein each of the variable phase shifters of the first set and the primary variable phase shifter includes means for providing two phase shift values in response to said control signal; and said control means comprises delivering means for delivering said control signal to said primary variable phase shifter and said first set of variable phase shifters to switch said phase shift values of each of said primary variable phase shifter and said first set of variable phase shifters from one phase shift value to another;

wherein each of said primary variable phase shifter and said first set of the variable phase shifters is formed on a dielectric substrate supported by a ground plate and comprises:

a first line formed on said dielectric substrate;

a second line formed on said dielectric substrate and spaced apart from said first line;

a transformer line formed on said dielectric substrate and serially coupled between said first and second lines for impedance matching said first line with said second line;

a pair of stubs, each having an end connected to said transformer line and an opposite end;

a first diode connected to the opposite end of said first stub;

a second diode connected to the opposite end of said second stub; and a bias element formed on said dielectric substrate and connected to said first line for transmitting said control signal to said first and second diodes through said first and second stubs;

wherein said first line, said second line and said transformer line define a path for connecting at least one of said external terminal to said input/output terminal and said input/output terminal to a respective one of said inner terminals.

2. An antenna device reciprocally operable for transmitting and receiving a radio wave, said antenna device comprising an antenna section for orienting said radio wave to a controllable direction and a control section connected to said antenna section for electronically controlling said controllable direction of the radio wave, said control section comprising an antenna block and an external terminal outside of said antenna block, said antenna block having a first set of inner terminals connected to said antenna section, a control terminal for receiving a control signal, and an input/output terminal, said control section comprising:

a first set of variable phase shifters each of which is formed in said antenna block and each of which is connected to a respective one of said first set of the inner terminals, said control terminal, and said input/output terminal and each of which variably phase shifts, under control of said control signal, an electric signal which is allowed to reciprocally pass through each of said variable phase shifters between one of said inner terminals of the first set and said input/output terminal, each of the electric signals being subjected to phase shifts in the variable phase shifters, resulting in phase shifted electric signals with accompanying phase errors different from one another;

additional variable phase shift means located outside of said antenna block and connected to said input-/output terminal, said external terminal, and said control terminal, said additional variable phase shift means being for variably phase shifting, under control of said control signal, an additional electric signal which is allowed to pass through said additional variable phase shift means between said input/output terminal and said external terminal to compensate for said phase errors, said additional electric signal being subjected to a phase shift in said additional variable phase shift means into an additional phase shifted electric signal which compensates for said phase errors in said phase shifted electric signals, said additional electric signal being given to said additional variable phase shift means either after a combination of said electric signals or before distribution to said first set of the variable phase shifters as said electric signals;

control means connected to said control terminal to be connected therethrough to said first set of variable phase shifters and the additional variable phase shift means through said control terminal, said control means being for producing said control signal to vary the phase shifts in said first set of the variable phase shifters and the additional variable phase shift means and to thereby control said first set of the variable phase shifters and said additional variable phase shift means;

wherein said antenna section comprises a plurality of antenna elements which are spaced apart by a predetermined distance and which are individually connected to said inner terminals associated with the first set of the variable phase shifters, and wherein the variable phase shifters of said first set are individually connected to said inner terminals associated with the first set and to said input/output terminal to produce said phase shifted electric signals resulting from a received radio wave;

said additional variable phase shift means including means for receiving said phase shifted electric signals as said additional electric signal and comprising:

an additional variable phase shifter connected between said input/output terminal and said external terminal for phase shifting said additional electric signal into said additional phase shifted signal; and means for supplying said additional phase shifted signal through said external terminal;

wherein each of the variable phase shifters of the first set and the additional variable phase shifter includes means for providing two phase shift values in response to said control signal; and said control means comprises delivering means for delivering said control signal to said additional variable phase shifter and said first set of variable phase shifters to switch said phase shift values of each of said additional variable phase shifter and said first set of variable phase shifters from one phase shift value to another;

wherein each of said additional variable phase shifter and said first set of the variable phase shifters is formed on a dielectric substrate supported by a ground plate and comprises:

a first line formed on said dielectric substrate;

a second line formed on said dielectric substrate and spaced apart from said first line;

a transformer line formed on said dielectric substrate and serially coupled between said first and second lines for impedance matching said first line with said second line;

a pair of stubs, each having an end connected to said transformer line and an opposite end;

a first diode connected to the opposite end of said first stub;

a second diode connected to the opposite end of said second stub; and a bias element formed on said dielectric substrate and connected to said first line for transmitting said control signal to said first and second diodes through said first and second stubs, respectively;

wherein said first line, said second line and said transformer line define a path for connecting at least one of said external terminal to said input/output terminal and said input/output terminal to a respective one of said inner terminals.

3. An antenna device reciprocally operable for transmitting and receiving a radio wave, said antenna device comprising an antenna section for orienting said radio wave to a controllable direction and a control section connected to said antenna section for electronically controlling said controllable direction of the radio wave, said control section comprising an antenna block and an external terminal outside of said antenna block, said antenna block having a first set of inner terminals connected to said antenna section, a control terminal for receiving a control signal, and an input/output terminal, said control section comprising:

a first set of variable phase shifters each of which is formed in said antenna block and each of which is connected to a respective one of said first set of the inner terminals, said control terminal, and said input/output terminal and each of which variably phase shifts, under control of said control signal, an electric signal which is allowed to reciprocally pass through each of said variable phase shifters between one of said inner terminals of the first set and said input/output terminal, each of the electric signals being subjected to phase shifts in the variable phase shifters, resulting in phase shifted electric signals with accompanying phase errors different from one another;

additional variable phase shift means located outside of said antenna block and connected to said input-/output terminal, said external terminal, and said control terminal, said additional variable phase shift means being for variably phase shifting, under control of said control signal, an additional electric signal which is allowed to pass through said additional variable phase shift means between said input/output terminal and said external terminal to compensate for said phase errors, said additional electric signal being subjected to a phase shift in said additional variable phase shift means into an additional phase shifted electric signal which compensates for said phase errors in said phase shifted electric signals, said additional electric signal being given to said additional variable phase shift means either after a combination of said electric signals or before distribution to said first set of the variable phase shifters as said electric signals;

control means connected to said control terminal to be connected therethrough to said first set of variable phase shifters and the additional variable phase shift means through said control terminal, said control means being for producing said control signal to vary the phase shifts in said first set of the variable phase shifters and the additional variable phase shift means and to thereby control said first set of the variable phase shifters and said additional variable phase shift means;

wherein each of said first set of the variable phase shifters is formed on a dielectric substrate supported by a ground plate and comprises:

a first line formed on said dielectric substrate;

a second line formed on said dielectric substrate and spaced apart from said first line;

a transformer line formed on said dielectric substrate and serially coupled between said first and second lines for impedance matching said first line with said second line;

a pair of stubs, each having an end connected to said transformer line and an opposite end;

a first diode connected to the opposite end of said first stub;

a second diode connected to the opposite end of said second stub; and a bias element formed on said dielectric substrate and connected to said first line for transmitting said control signal to said first and second diodes through said first and second stubs;

wherein said first line, said second line and said transformer line define a path for connecting at least one of said external terminal to said input/output terminal and said input/output terminal to a respective one of said inner terminals.

4. An antenna device as claimed in claim 3, wherein said antenna section comprises a plurality of antenna elements which are spaced apart by a predetermined distance on said dielectric substrate and which are individually connected to said inner terminals associated with the first set of the variable phase shifters, and wherein;

said additional variable phase shift means includes means for receiving said additional electric signal from said external terminal to produce said additional phase shifted electric signal through said input/output terminal when a radio signal is to be transmitted and comprises:

a primary variable phase shifter located outside of said dielectric substrate and connected between said external terminal and said input/output terminal for phase shifting said additional electric signal into said additional phase shifted electric signal; and first signal supplying means for supplying said additional phase shifted electric signal from said input/output means to said first set of variable phase shifters.

5. An antenna device as claimed in claim 4, wherein each of the variable phase shifters of the first set and the primary variable phase shifter includes means for providing two phase shift values in response to said control signal; and said control means comprises delivering means for delivering said control signal to said primary variable phase shifter and said first set of the variable phase shifters to switch said phase shift values of each of said primary variable phase shifter and said first set of the variable phase shifters from one phase value to another, said primary variable phase shifters and said delivering means being located outside of said dielectric substrate.

* * * * *